US006705554B1

(12) United States Patent
Kölle

(10) Patent No.: US 6,705,554 B1
(45) Date of Patent: Mar. 16, 2004

(54) ROTOR FOR A PAPER STOCK PROCESSING MACHINE, ANTI-WEAR ELEMENT FOR SUCH A ROTOR, AND PAPER STOCK PROCESSING APPARATUS

(75) Inventor: Gunther Kölle, Steinheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/577,570

(22) Filed: May 25, 2000

(30) Foreign Application Priority Data

Jun. 9, 1999 (EP) ..... 99111193

(51) Int. Cl.[7] ..... B02B 11/00; B02C 11/08

(52) U.S. Cl. ..... 241/46.11; 241/46.17; 241/162; 241/298; 241/300; 162/232; 162/55; 366/307; 366/317

(58) Field of Search ..... 366/307, 317, 366/171.7, 299, 603, 66, 168.2; 162/232, 55; 241/46.11, 46.17, 162, 298, 300, 273, 291, 292, 68, 69, 70, 71, 72, 73, 74, 75, 76

(56) References Cited

U.S. PATENT DOCUMENTS 3,304,056 A * 2/1967 Akio Sohma ..... 253/76
3,365,126 A * 1/1968 Stoffer et al. ..... 230/132
3,608,976 A * 9/1971 Zugelder ..... 302/37
4,480,796 A * 11/1984 Paraskevas ..... 241/46.11
5,509,536 A * 4/1996 Mannes ..... 209/273

FOREIGN PATENT DOCUMENTS

| | | |
|---|---|---|
| BE | 1010118 | 1/1998 |
| DE | 19649764 | 6/1997 |
| WO | 98/49389 | 11/1998 |

* cited by examiner

*Primary Examiner*—Steven P. Griffin
*Assistant Examiner*—Mark Halpern
(74) *Attorney, Agent, or Firm*—Greenblum & Bernstein, P.L.C.

(57) ABSTRACT

Rotor for a paper stock processing machine, an anti-wear element for protecting a leading front surface of a rotor blade, and a paper stock processing apparatus. The rotor includes at least one rotor blade having a leading front surface to be protected, and an anti-wear element comprising a base body and at least one wear-resistant surface. The anti-wear element is coupled to the leading front surface. The anti-wear element includes a base body with a back side, and at least one wear-resistant working surface. The back side is formed to correspond to a shape of, and to be coupled to, the leading front edge. The apparatus includes a tank, a screen, and a rotor rotatably coupled adjacent the screen. The rotor includes at least one rotor blade having a leading front surface, relative to a rotational direction of the rotor, and an anti-wear element coupled to the leading front edge. The anti-wear element includes a base body and a wear-resistant working surface.

28 Claims, 3 Drawing Sheets

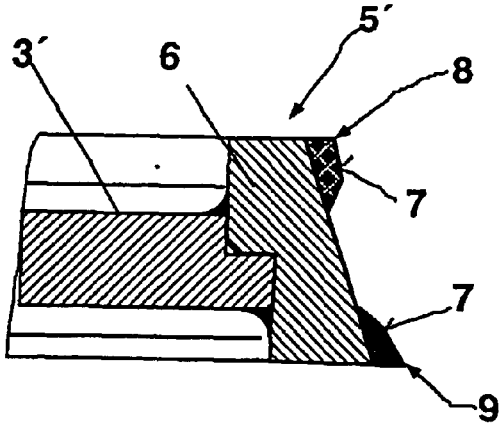
Fig. 4
Fig. 5
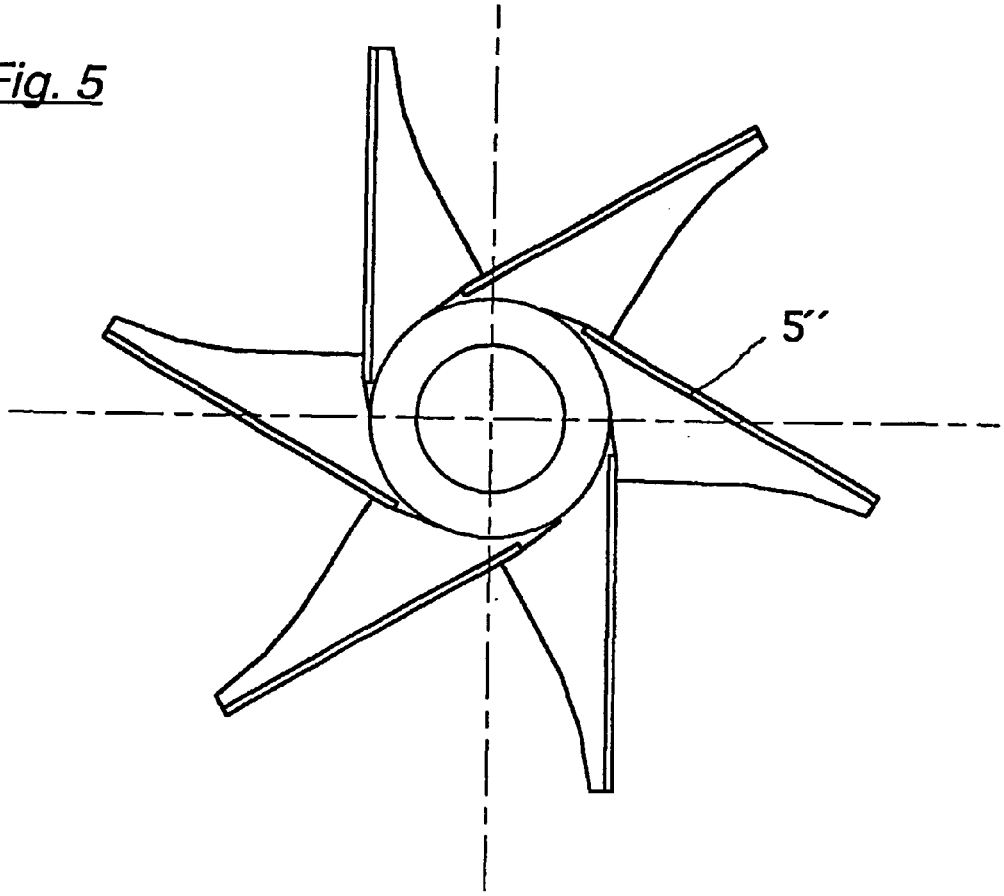

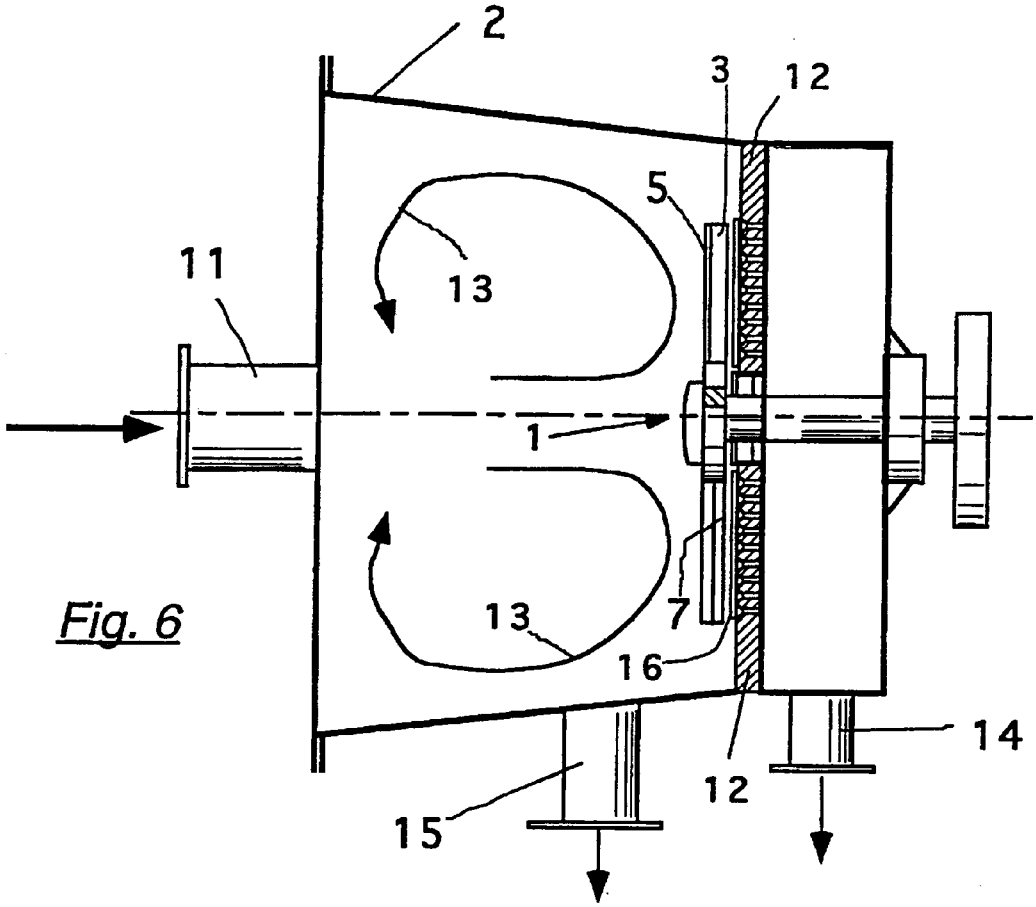
Fig. 6
Fig.7
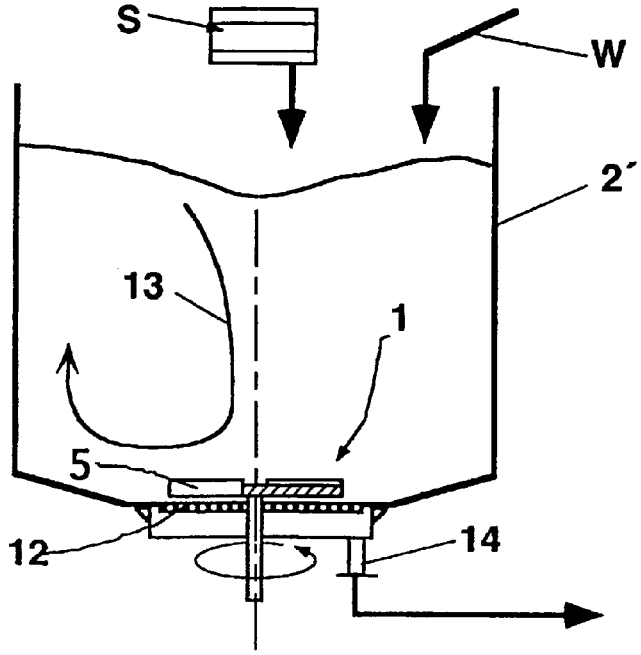

ROTOR FOR A PAPER STOCK PROCESSING MACHINE, ANTI-WEAR ELEMENT FOR SUCH A ROTOR, AND PAPER STOCK PROCESSING APPARATUS

CROSS-REFERENCE TO RELATED APPLICATIONS

The present application claims priority under 35 U.S.C. § 119 of European Patent Application No. 99 11 1193.1, filed on Jun. 9, 1999, the disclosure of which is expressly incorporated by reference herein in its entirety.

BACKGROUND OF THE INVENTION

1. Field of the Invention

The invention relates to a rotor that can be located within a tank of the paper stock processing machine. The rotor has at least one rotor blade for creating circulation of the stock suspension contained in the tank, and protection against wear is located on a leading front surface of the rotor blade, as viewed in the rotational direction of the rotor.

Further, the invention relates to an anti-wear element for protecting a rotor blade of a rotor located arranged in a tank of a paper stock processing machine. The rotor blades are adapted to circulate a stock suspension contained in the tank.

The invention also relates to a paper stock processing apparatus having at least one rotor blade for creating circulation of a stock suspension in a tank.

2. Discussion of Background Information

A rotor similar in general to that discussed above is known. Normally, it is used not only for circulating the stock suspension, but also for breaking up paper stock contained in the stock suspension. If it is moved directly alongside a screen, it keeps the screen free of blockages and therefore serves as a screen clearer. In this known rotor, wear protection is applied by welding wear-resistant material to the leading front surface of each rotor blade as seen in the rotational direction of the rotor.

SUMMARY OF THE INVENTION

The present invention provides a rotor for a paper stock processing machine as well as an anti-wear element for protecting the rotor blades in which or by the use of which the strength of the rotor blades is substantially increased. Replacement of worn parts without damaging the rotor blades is also possible.

According to the present invention, an anti-wear element, adapted to protect against wear, having a base body with at least one wear-resistant working surface is coupled to the rotor blade.

Moreover, the invention also provides an anti-wear element having a base body with at least one wear-resistant working surface and a back side. The anti-wear element is formed to be coupled, e.g., welded, to a leading front edge, as viewed in the rotational direction of the rotor, of the rotor blade to be protected.

In the invention, the anti-wear element is produced separately from a base body and a wear resistant shield and is then welded onto the rotor blade. In this manner, it is possible to eliminate the currently conventional process of welding thick shields onto the rotor blades which adversely affects the material structure of the rotor blades. The welded bond performed according to the present invention only serves to secure the anti-wear element and, therefore, is substantially more gentle to produce. A further advantage is that the edges of the anti-wear element are already preworked before being installed so that time-consuming additional grinding of the edges on the rotor can be omitted.

As soon as the rotor blades of the rotor no longer circulate the stock suspension sufficiently or the paper stock contained in the stock suspension is no longer being broken up sufficiently, the anti-wear element can be removed by separation along the welding seam and can be replaced with a new anti-wear element. The removal and replacement of the anti-wear element preferably occurs after removal of the rotor from the stock processing machine. The replacement of worn rotors can then take place using"replacement rotors."

It must be assumed that the stress placed on the wear element by forces acting on it during operation is very high. Such forces, however, can be absorbed with little effort if the front surface of the rotor blade and the back surface of the anti-wear element are matched to one another such that a large carrying surface is made available. Then, a relatively weak welding seam is sufficient for a secure fastening and can, if necessary, also be broken.

It is possible to specifically influence the hydraulic effect of the rotor blade by special construction of the anti-wear element, e.g., to change the flow movements within the stock suspension or to increase or decrease the breaking-up effect of the rotor. In this manner, it is possible to equip the paper stock processing machines for different operating conditions without departing from the basic concept of a rotor. In the practice of paper stock processing, there is namely a multitude of different requirements, e.g., because of raw materials.

The present invention is directed to a rotor for a paper stock processing machine. The rotor includes at least one rotor blade having a leading front surface to be protected, and an anti-wear element comprising a base body and at least one wear-resistant surface. The anti-wear element is coupled to the leading front surface.

In accordance with a feature of the present invention, the anti-wear element can be welded to the leading front surface.

According to another feature of the invention, the rotor can be utilized in combination with a tank of a paper stock processing machine. The rotor can be rotatably mounted within the tank to circulate a stock suspension in the tank. Further, the paper stock processing machine can be a primary pulper having a horizontally oriented screen, and the rotor can be rotatably mounted so that the leading front surface positioned adjacent the screen. Alternatively, the paper stock processing machine can be a secondary pulper having a vertically oriented screen, and the rotor can be rotatably mounted so that the leading front surface positioned adjacent the screen.

In accordance with another feature of the instant invention, the at least one wear-resistant working surface can include a layer of wear-resistant material that is firmly coupled to the base. The at least one wear-resistant material may be fixed onto the base body by hard facing. Moreover, the anti-wear element can be formed separately from the rotor, and the anti-wear element may be welded to the at least one rotor blade.

Further, the at least one rotor blade can include a plurality of rotor blade having leading front surfaces, and at least one partial section of each leading front surface of each rotor blade, radially inwardly from a free end, may be completely covered by the anti-wear element.

Moreover, a portion of the anti-wear element coupled to the at least one rotor blade can protrude past the leading front surface. The portion extends past the leading front surface in a direction adapted to face a screen in a paper stock processing machine.

In accordance with still another feature of the present invention, a face of the anti-wear element can be beveled at an angle a of between approximately 1° and 45° from parallel to a rotational axis of said rotor. Further, the face of the anti-wear element may be beveled such that a radial distance of a surface of the face from the rotational axis increases in a direction toward the leading front surface.

According to a still further feature of the invention, the leading front surface can have one of a cylindrical and conical ring segment shape.

The present invention is also directed to an anti-wear element for protecting a leading front surface of a rotor blade. The anti-wear element includes a base body with a back side, and at least one wear-resistant working surface. The back side is formed to correspond to a shape of, and to be coupled to, the leading front edge.

According to a feature of the invention, the back side may be welded to the leading front edge.

In accordance with another feature of the present invention, the rotor blade protected by the anti-wear coating can be utilized in combination with a tank of a paper stock processing machine. The rotor blades may be adapted to circulate a stock suspension contained in the tank.

Further, the wear-resistant working surface can include a wear-resistant material, and the wear-resistant material can be a non-rusting, alloyed high-grade steel.

In accordance with a still further feature of the invention, the base body can have one of a cylindrical and conical ring segment shape.

Moreover, the wear-resistant working surface may be welded to the base body and the wear-resistant surface can be arranged to form at least one front edge that extends over an edge of the base body opposite the back side. A curvature radius of the front edge can be a maximum of approximately 2 mm.

The present invention is directed to a paper stock processing apparatus. The apparatus includes a tank, a screen, and a rotor rotatably coupled adjacent the screen. The rotor includes at least one rotor blade having a leading front surface, relative to a rotational direction of the rotor, and an anti-wear element coupled to the leading front edge. The anti-wear element includes a base body and a wear-resistant working surface.

According to a feature of the instant invention, the base body may be welded to the leading front surface, and the wear-resistant working surface may be coupled to the base body.

A portion of the anti-wear element may be arranged to protrude past the leading front surface. The portion that extends past the leading front surface in a direction can be adapted to face the screen.

In accordance with yet another feature of the invention, wherein the tank may be a primary pulper tank. Alternatively, the tank may be a secondary pulper tank.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 4 illustrates a section of another embodiment of the invention;

FIG. 5 illustrates a rotor with straight blades;

FIG. 6 illustrates a secondary pulper as an exemplary use of the rotor according to the invention; and FIG. 7 illustrates a primary pulper as an exemplary use of the rotor according to the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
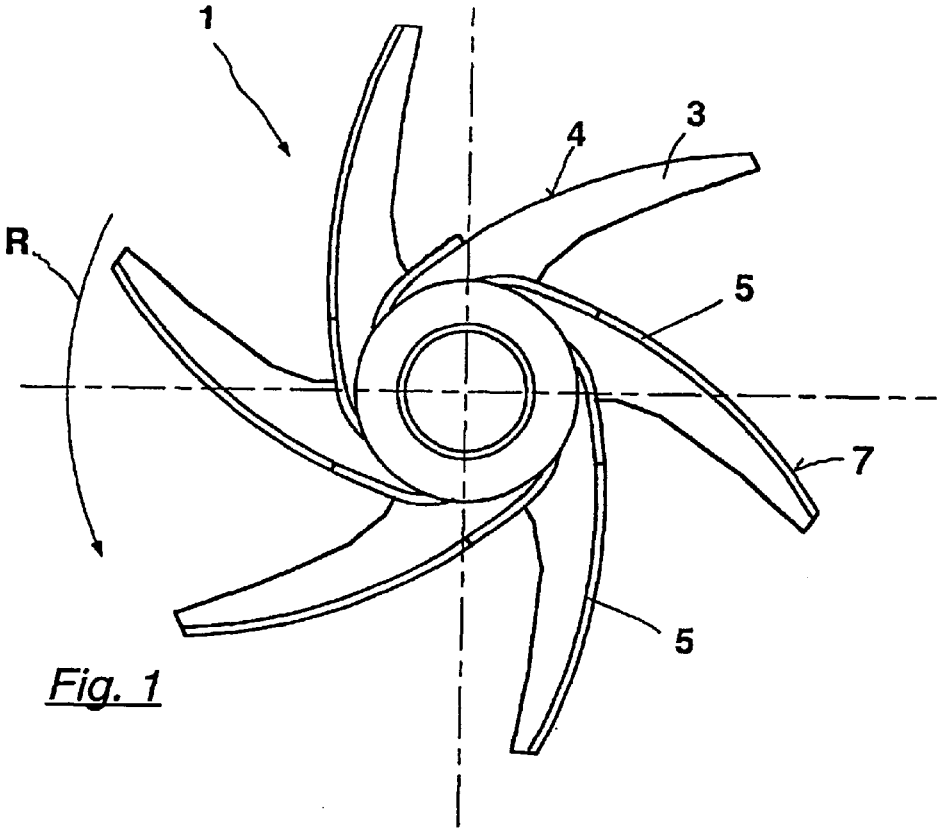
FIG. 1 illustrates a view of a rotor according to the features of the present invention.

The rotor 1 shown in FIG. 1 has a total of six curved rotor blades 3. The rotor blades are provided with anti-wear elements 5 which are welded onto leading front surfaces 4 viewed in the rotational direction R of the rotor 1. For the sake of clarity, one rotor blade 3 is shown without an anti-wear element so that leading front surface 4 on that rotor is exposed. It is more advisable to provide all the rotor blades 3 with anti-wear elements 5 when the rotor is used in the paper stock processing machine. The anti-wear elements carry wear-resistant working surfaces 7 on their front surfaces.

Figure 2:
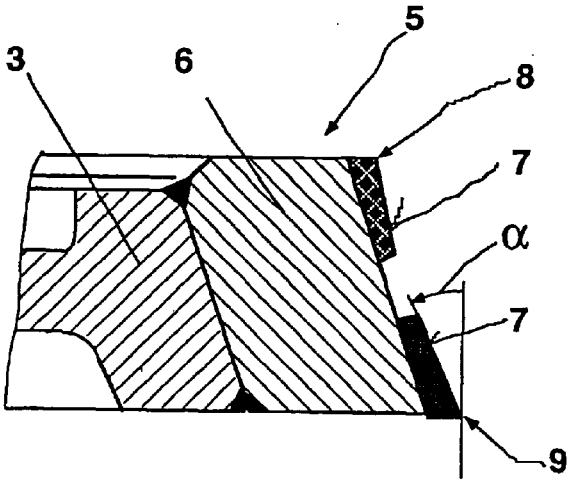
FIG. 2 illustrates a section of a rotor blade/anti-wear element combination.

FIG. 2 shows a section through a rotor blade 3 and through an anti-wear element 5. It can be seen here that anti-wear element 5 includes of a base body 6 to which wear-resistant working surfaces 7 are attached. It is advisable for working surfaces 7 to be produced by hard facing. However, other possibilities are conceivable for producing such a working surface and connecting it securely to base body 6, e.g., plasma spraying or high-temperature soldering. As already mentioned, the hard facing is applied to base body 6 before it is welded to rotor blade 3. Because of this construction of the rotor, very good possibilities arise for structuring wear-resistant working surfaces 7 such that they are sufficient for the demands placed on them during the use of the rotor. The illustration in FIG. 2 is to be understood in that, in the assembly phase, the side of the rotor located at the bottom of the figure is adapted to face the wall of the tank while the side located at the top of the figure is adapted to face the inner volume of the tank. Therefore, lower front edge 9 of rotor blade 3 is accorded particular significance. That is, if the tank is provided with a screen which is to be kept free from blockages by rotor 1, the particular form or arrangement of this part of wear-resistant working surface 7 and of front edge 9 becomes important. Further, even upper front edge 8 has an influence on the working effect of rotor 1. Wear resistant working surface 7 is positioned on lower edge 9 to form an angle of α to the vertical (e.g., parallel to a rotational axis of rotor 1). This a is very necessary for the clearing effect of rotor 1. In other cases, it may be preferable to arrange wear-resistant working surface 7 vertically, i.e., at an angle α of 0°, or even at a negative angle.

Figure 3:
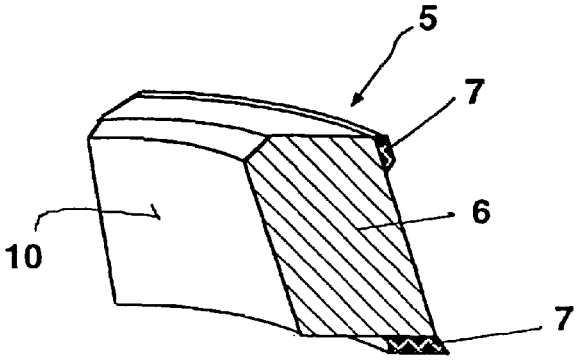
FIG. 3 illustrates a part of an anti-wear element, shown in a partial perspective.

FIG. 3 illustrates a part of an anti-wear element 5 according to the invention which has a back side 10 that is bent in the shape of a tapered ring and is provided with somewhat different wear-resistant working surfaces 7 than those depicted in FIG. 2. Logically, the part of the rotor blade (not shown) to be connected to anti-wear element 5 is also formed in the shape of a tapered ring in order to facilitate welding and to be able to optimally absorb any forces that may arise.

The connection shown in FIG. 4 between rotor blade 3 and anti-wear element 5' is carried out using a shoulder, which facilitates mounting and separation. The rotor 3' is substantially simplified.

As a further example, FIG. 5 illustrates another embodiment of the invention of a rotor with straight rotor blades. Anti-wear elements 5" are formed as straight strips and can be welded to equally straight surfaces. While this embodiment is considerably cheaper than the other described embodiments, this arrangement generally has fewer applications than the other described embodiments.

Paper stock processing machines, e.g., pulpers, can utilize rotors of the type described herein. As is known, there is a difference between primary pulpers and secondary pulpers. As illustrated in FIG. 6, a secondary pulper can be particularly demanding with respect to anti-wear properties and to a hydraulic effect of the rotor used. This is due, e.g., to the compactness of such machines and to their high throughput. Stock that is processed in secondary pulpers, e.g., waste paper, usually contains a substantial percentage of foreign matter, which can severely obstruct the rotor. Thus, the operationally safe functioning of these machines depends on reliably keeping the wires free of obstructions. Moreover, a dissolving effect, i.e., a further breaking up of the suspended paper stock, is desired in many cases. All of these requirements lead to the fact that the rotors must be wear resistant and that the working edges of these rotors must remain in their intended shape for as long as possible before they are rounded off or worn out due to wear. The depicted exemplary secondary pulper has a central entry 11 for paper stock suspension in a housing 2. Rotor 1 keeps wire 12 free of obstructions and produces a circulation (arrow 13) in housing 2. The part of the suspension that passes through wire 12 leaves the housing through an accepted stock opening 14 while the rejected stock is drained out through a reject drain 15. The function of such secondary pulpers is generally known, and variations in their arrangement are possible in the flow guide, e.g., a tangential inlet and central reject drain.

FIG. 7 illustrates a typical primary pulper, which functions in a generally known manner. As shown in the exemplary figure, rotor 1 is placed into rotation on a floor of tank 2' and, thus, keeps wire 12, which is resting on floor, free of obstructions. In a primary pulper, a paper pulp S, along with water W, is introduced over the free surface of the suspension.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A rotor for a paper stock processing machine comprising:

at least one rotor blade having a leading front surface to be protected;

an anti-wear element comprising a base body coupled to at least one wear-resistant surface; and said anti-wear element being coupled to said leading front surface.

2. The rotor in accordance with claim 1, wherein said anti-wear element is welded to said leading front surface.

3. The rotor in accordance with claim 1 in combination with a tank of a paper stock processing machine, wherein said rotor is rotatably mounted within said tank to circulate a stock suspension in said tank.

4. The rotor in accordance with claim 3, wherein said paper stock processing machine is a primary pulper having a horizontally oriented screen, and said rotor is rotatably mounted so that said leading front surface positioned adjacent said screen.

5. The rotor in accordance with claim 3, wherein said paper stock processing machine is a secondary pulper having a vertically oriented screen, and said rotor is rotatably mounted so that said leading front surface positioned adjacent said screen.

6. The rotor in accordance with claim 1, wherein said at least one rotor blade comprises a plurality of rotor blade having leading front surfaces, and at least one partial section of each said leading front surface of each rotor blade, radially inwardly from a free end, is completely covered by said anti-wear element.

7. The rotor in accordance with claim 1, wherein a portion of said anti-wear element coupled to said at least one rotor blade protrudes past said leading front surface.

8. The rotor in accordance with claim 7, wherein said portion extends past said leading front surface in a direction adapted to face a screen in a paper stock processing machine.

9. The rotor in accordance with claim 1, wherein a face of said anti-wear element is beveled at an angle α of between approximately 1° and 45° from parallel to a rotational axis of said rotor.

10. The rotor in accordance with claim 9, wherein said face of said anti-wear element is beveled such that a radial distance of a surface of said face from said rotational axis increases in a direction toward said leading front surface.

11. The rotor in accordance with claim 1, wherein said leading front surface has one of a cylindrical and conical ring segment shape.

12. A rotor for a paper stock processing machine comprising:

at least one rotor blade having a leading front surface to be protected;

an anti-wear element comprising a base body and at least one wear-resistant surface;

wherein said anti-wear element is coupled to said leading front surface, and said at least one wear-resistant surface comprises a layer of wear-resistant material that is firmly coupled to said base body.

13. The rotor in accordance with claim 12, wherein said layer of wear-resistant material is fixed onto said base body by hard facing.

14. The rotor in accordance with claim 12, wherein said anti-wear element is formed separately from said rotor, and said anti-wear element is welded to said at least one rotor blade.

15. An anti-wear element for protecting a leading front edge of a rotor blade, comprising:

a base body with a back side; and at least one wear-resistant working surface coupled to said base body, wherein said back side is formed to correspond to a shape of, and to be coupled to, the leading front edge.

16. The anti-wear element in accordance with claim 15, wherein said back side is welded to said leading front edge.

17. The anti-wear element in accordance with claim 15, in combination with a tank of a paper stock processing machine, wherein the rotor blades are adapted to circulate a stock suspension contained in said tank.

18. The anti-wear element in accordance with claim 15, wherein said wear-resistant working surface comprises a wear-resistant material.

19. The anti-wear element in accordance with claim 18, wherein said wear-resistant material comprises a non-rusting, alloyed high-grade steel.

20. The anti-wear element in accordance with claim 15, wherein said base body has one of a cylindrical and conical ring segment shape.

21. The anti-wear element in accordance with claim 15, wherein said wear-resistant working surface is welded to said base body and said wear-resistant surface is arranged to form at least one front edge that extends over an edge of said base body opposite said back side.

22. The anti-wear element in accordance with claim 21, wherein a curvature radius of said front edge is a maximum of approximately 2 mm.

23. A paper stock processing apparatus comprising:

a tank;

a screen;

a rotor rotatably coupled adjacent said screen;

said rotor comprising at least one rotor blade having a leading front surface, relative to a rotational direction of said rotor, and an anti-wear element coupled to said leading front surface; aid said anti-wear element comprising a base body coupled to a wear-resistant working surface.

24. The apparatus in accordance with claim 23, wherein said base body is welded to said leading front surface, and said wear-resistant working surface is coupled to said base body.

25. The apparatus in accordance with claim 23, wherein a portion of said anti-wear element is arranged to protrude past said leading front surface.

26. The apparatus in accordance with claim 25, wherein said portion extends past said leading front surface in a direction adapted to face said screen.

27. The apparatus in accordance with claim 23, wherein said tank is a primary pulper tank.

28. The apparatus in accordance with claim 23, wherein said tank is a secondary pulper tank.

* * * * *